US005457976A

United States Patent [19]

Stillwagon

[11] Patent Number: 5,457,976

[45] Date of Patent: Oct. 17, 1995

[54] DOUBLE ENDED KEY HOLDER WITH DISCONNECT

[75] Inventor: Woodrow C. Stillwagon, Atlanta, Ga.

[73] Assignee: Stillwagon Applied Technology, Inc., Hilliard, Ohio

[21] Appl. No.: 289,501

[22] Filed: Aug. 12, 1994

[51] Int. Cl.[6] ..... A47G 29/10

[52] U.S. Cl. ..... 70/456 R; 24/3.6

[58] Field of Search ..... 70/456 R, 456 B, 70/457, 458, 459; 292/179; D3/207, 210, 208, 209; 206/37.1, 37.2, 37.8; 24/3 K

[56] References Cited

U.S. PATENT DOCUMENTS

| | | | |
|---|---|---|---|
| D. 271,443 | 11/1983 | MacDonald | D3/61 |
| D. 285,987 | 10/1986 | MacDonald | D3/61 |
| D. 299,480 | 1/1989 | Harari | D3/61 |
| D. 306,799 | 3/1990 | Colan | D3/61 |
| D. 308,601 | 6/1990 | McDonald | D3/61 |
| D. 310,136 | 8/1990 | MacDonald | D3/61 |
| 360,113 | 3/1887 | Reinisch et al. | 292/179 |
| 1,199,690 | 9/1916 | Gillam | 70/457 |
| 2,674,774 | 4/1954 | Modrey | 70/457 |
| 2,726,889 | 12/1955 | Lawson | 292/DIG. 27 |
| 3,299,679 | 1/1967 | Anderson | 70/459 |
| 3,600,917 | 8/1971 | Kroek | 70/459 |
| 3,768,847 | 10/1973 | Buck, Jr. et al. | 292/179 |
| 4,079,607 | 3/1978 | Spruyt | 70/456 |
| 4,179,143 | 12/1979 | Shy | 292/DIG. 37 |
| 4,776,191 | 10/1988 | MacDonald | 70/459 |
| 4,821,543 | 4/1989 | Scungio | 70/456 |
| 5,050,414 | 9/1991 | Huang | 70/456 |
| 5,058,405 | 10/1991 | Stillwagon | 70/456 |
| 5,177,989 | 1/1993 | Stillwagon | 70/456 |
| 5,209,090 | 5/1993 | Stillwagon | 70/456 R |

FOREIGN PATENT DOCUMENTS

| | | | |
|---|---|---|---|
| 1224203 | 2/1959 | France | 70/459 |

*Primary Examiner*—Peter M. Cuomo
*Assistant Examiner*—Darnell M. Boucher
*Attorney, Agent, or Firm*—Louis T. Isaf; James A. Witherspoon

[57] ABSTRACT

Provided is a key chain including a body defining a cavity that is accessible through a sleeve connected to the body. An insert member inserts through the sleeve to engage a biased button member that is movably disposed within the cavity. The button member defines an aperture that receives a portion of the insert member and the button member moves between a first position and a second position to selectively latch and release, respectively, the insert member to the body. The sleeve protrudes into the button aperture to restrict movement of the button member. A first key ring is attached to the body and a second key ring is attached to the insert member, whereby the key rings are disconnected when the insert member is withdrawn from the body and the key rings are connected with the insert member is inserted into the cavity and latched to the body.

24 Claims, 2 Drawing Sheets

DOUBLE ENDED KEY HOLDER WITH DISCONNECT

BACKGROUND OF THE INVENTION

The present invention relates generally to the field of latching or push button devices, and more particularly to the field of key chains which can be separated into two parts.

Numerous key chain designs are in use to day, from simple key rings to deluxe key cases finished to match accessory items, such as wallets and purses. Some are designed with two ring portions which can be separated. With such dual key chains, keys can be divided logically with one group of keys, such as keys for the home, on one ring and another group of keys, such as for the car or office, on the other ring.

The ability to separate home or office keys from car keys provides an extra measure of safety which often comes in handy when leaving a car for service, or with valet parking, etc. Doing so greatly reduces the chances of home or office keys falling into the wrong hands. Most people probably consider separating car keys from the rest of their keys when leaving their car with a stranger; making this easier to do increases the likelihood of actually following through with the idea.

While a number of dual key chains have been proposed and provided, they leave room for improvement. For example, certain dual key chains utilize a push button to facilitate separation of the key rings, and certain of those push buttons can be difficult to operate. Such difficulty can result, for example, in broken fingernails. Further, certain dual key chains operate in such a fashion that the integrity of the connection between the key rings is suspect.

One prior dual key chain, invented by the present inventor, is presented in U.S. Pat. No. 5,058,405. That key chain includes a push button latching device that removably secures one key ring to another. That key chain includes a body defining a cavity therein. An insert member is capable of being inserted into the cavity to define an inserted configuration, and the insert member is further capable of being withdrawn from the cavity to define a withdrawn configuration. A first key ring is attached to the body and a second key ring is attached to the insert member, whereby the key rings are disconnected when the key chain is in the withdrawn configuration and connected when the key chain is in the inserted configuration.

A loop member is movably disposed within the cavity of that key chain. The loop member selectively latches to the insert member to retain the insert member in the inserted configuration. The insert member protrudes through the loop member when in the inserted configuration, and the loop member is biased toward a first position. When the insert member is in the inserted configuration and the loop member is in the first position, the loop member engages the insert member in a manner that connects the insert member to the body, whereby the first key ring is connected to the second key ring. A button member is capable of being depressed such that the loop member achieves a second position. When the insert member is in the inserted configuration and the loop member is in the second position, the loop member cooperates with the insert member to allow withdrawal of the insert member from the body, whereby the first key ring and the second key ring are separated.

SUMMARY OF THE INVENTION

Briefly described, the present invention includes a push button latching device that is, for example and not limitation, employed in a key chain to removably secure one key ring to another. In accordance with the preferred embodiment of the present invention, the movement of a button member is restricted by a restricting object. The button member moves to engage and latch to an insert member; however, the insert member is not the aforementioned restricting object. The restricting object preferably protrudes into an aperture defined within the button member and restricts both rotational as well as translational movement of the button member. The restricting object is preferably a sleeve through which the insert member is inserted and withdrawn.

It is therefore an object of the present invention to provide a push button latching device.

Another object of the present invention is to provide a key chain that includes a push button latching device.

Yet another object of the present invention is to provide a push button assembly that is easy to operate.

Still another object of the present invention is to provide a push button assembly that engages with an audible click.

Still another object of the present invention is to provide a dual key chain with key rings that are capable of being easily and safely separated.

Still another object of the present invention is to promote the safe keeping of keys.

Still another object of the present invention is to improve home and office security.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
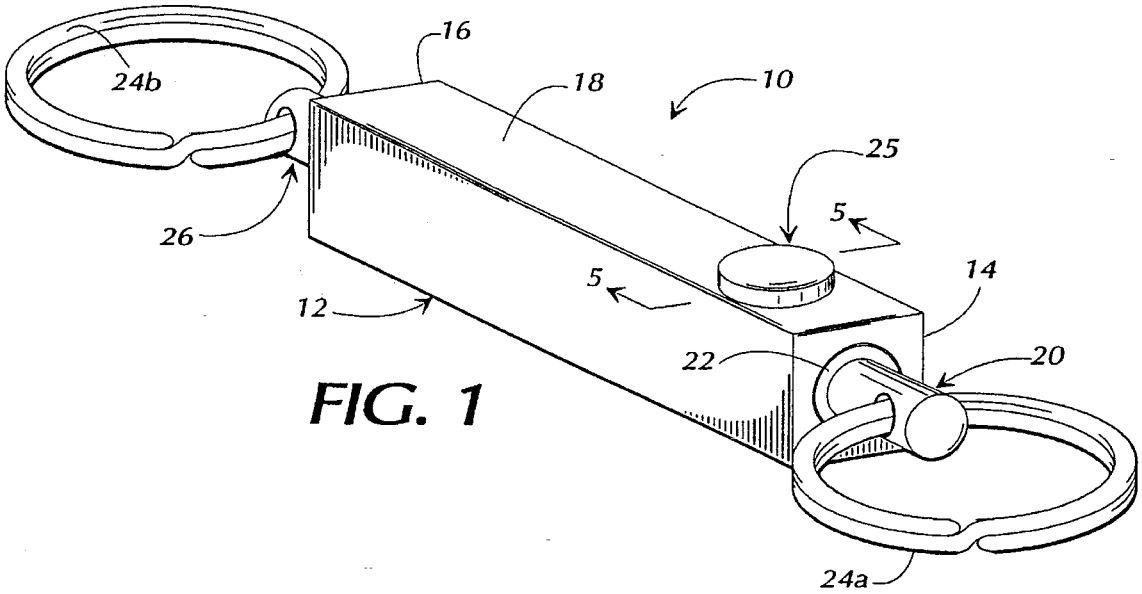
FIG. 1 is a perspective view of a key chain in accordance with the preferred embodiment of the present invention.

Referring now in greater detail to the drawings, in which like numerals represent like components throughout the several views, FIG. 1 is a perspective view of a key chain 10, in accordance with the preferred embodiment of the present invention. The key chain 10 includes a body 12 that defines a front end 14, a rear end 16 and a top side 18. An insert member 20, which is encircled by a sleeve 22, extends from the front end 14 of the body 12. A split ring **24*a*, for receiving keys (not shown), is movably connected to the insert member 20 by virtue of passing through a hole defined through the insert member 20. A button member 25 protrudes from the top side 18 of the body 12. A swivel member 26 extends from the rear end 16 of the body 12 and a split ring 24*b*, for receiving keys (not shown), is movably connected to the swivel member 26 by virtue of passing through a hole defined through the swivel member 26. As discussed in greater detail below, the key chain 10 is depicted in an inserted configuration in FIG. 1. As is also discussed in greater detail below, the key chain 10 is capable of being configured in a withdrawn configuration by depressing the button member 25 and withdrawing the insert member 20 from the body 12**.

Figure 3:
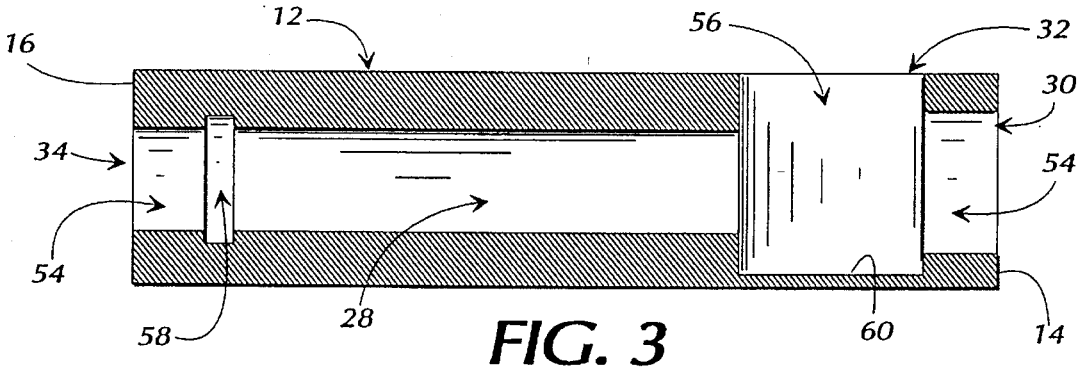
FIG. 3 is an isolated cross-sectional view of a body portion of the key chain of FIG. 1, taken along line 3—3 of FIG. 2.
Figure 2:
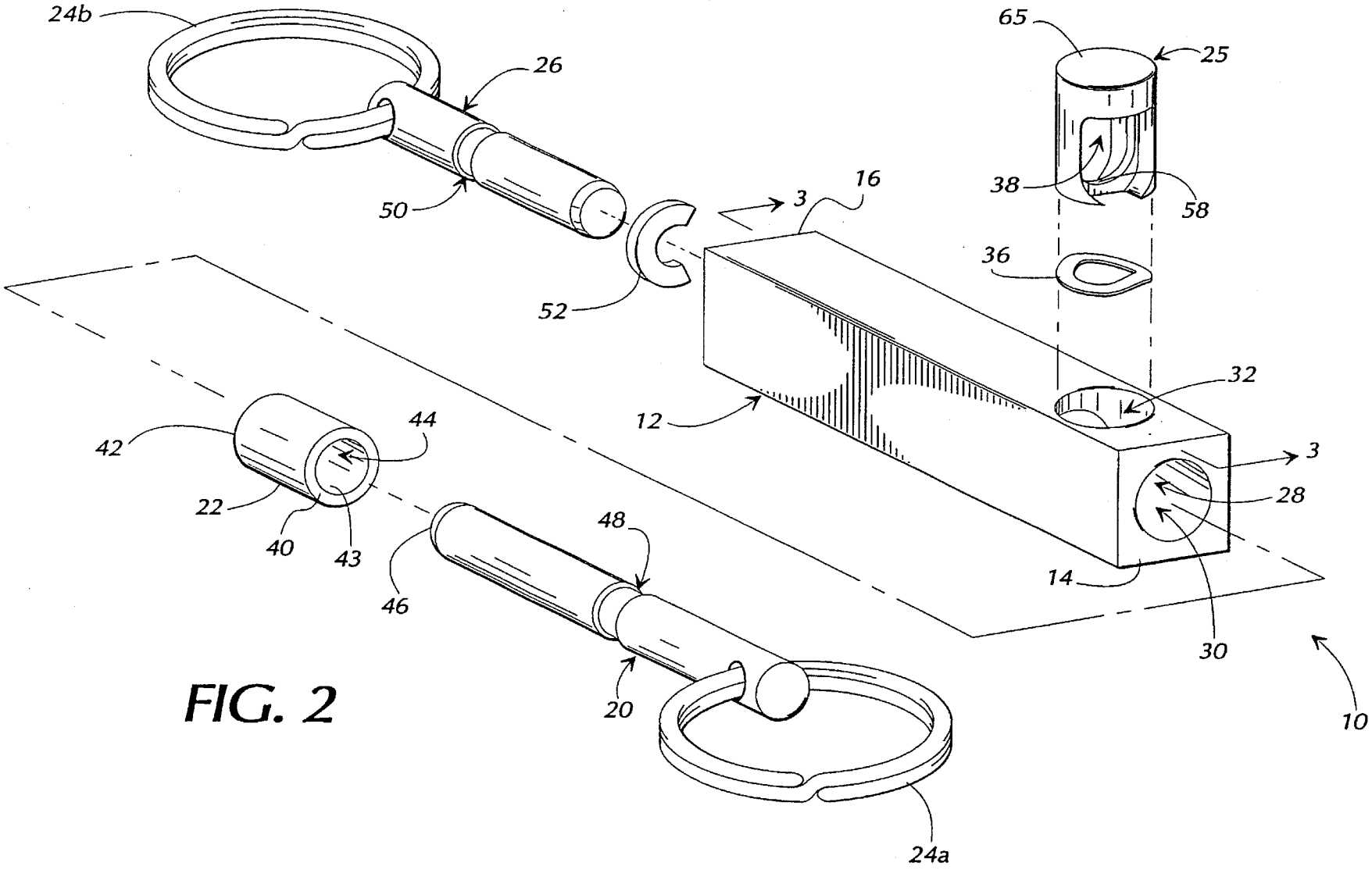
FIG. 2 is an exploded perspective view of the key chain of FIG. 1.

FIG. 2 is an exploded perspective view of the key chain 10 in accordance with the preferred embodiment of the present invention. The body 12 defines an internal cavity 28 that is accessible at a front opening 30, a top opening 32, and a rear opening 34 (FIG. 3). A biasing member, which is preferably in the form of a spring 36, is disposed within the cavity 28 below the button member 25. The button member 25 defines a button aperture 38 that extends therethrough. The sleeve 22 includes a sleeve front 40 oriented at the front end 14 of the body 12, and a sleeve rear 42 disposed within the cavity 28. The sleeve 22 further includes an internal surface 43 that defines a sleeve bore 44 that extends from the sleeve front 40 to the sleeve rear 42. In accordance with the preferred embodiment of the present invention, the sleeve 22 and sleeve bore 44 are cylindrical in shape. The insert member 20 is, in accordance with the preferred embodiment of the present invention, in the form of an elongated cylindrical post. The insert member 20 defines a generally smooth and rounded insertion end 46 and an annular groove 48 therearound. The insertion end 46 passes through the sleeve bore 44, and then through the button aperture 38 such that the groove 48 is within the button aperture 38. The swivel member 26 is, in accordance with the preferred embodiment of the present invention, in the form of an elongated cylindrical post and defines an annular groove 50 therearound that is occupied, at least partially, by a retaining ring 52.

FIG. 3 is an isolated cross-sectional view of the body 12 taken along line 3—3 of FIG. 2, in accordance with the preferred embodiment of the present invention. In accordance with the preferred embodiment of the present invention, the cavity 28 is defined by a pair of perpendicular, overlapping, and cylindrical bores 54,56 which are defined by the body 12 and are referred to as the primary bore 54 and the secondary bore 56. The primary bore 54 extends from the front end 14 to the rear end 16 of the body 12. The primary bore 54 defines a larger diameter between the front opening 30 and the secondary bore 54 than it does rearward of the secondary bore 54. The body 12 defines an annular groove 58 that encircles the primary bore 54. The retaining ring 52 (FIG. 2) that at least partially extends into the groove 50 (FIG. 2) expands to also occupy, at least partially, the groove 58 such that the swivel member 26 (FIG. 2) is attached to and capable of swiveling with respect to the body 12. The secondary bore 56 extends from the top opening 32, through the primary bore, and then preferably terminates within the body 12 to define a terminus 60.

Figure 4:
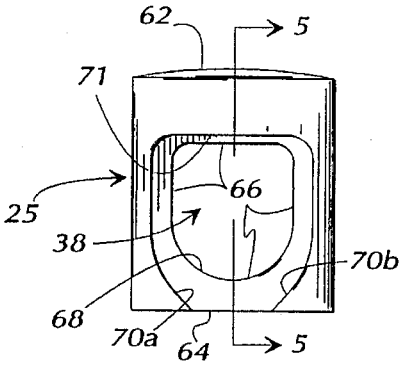
FIG. 4 is an isolated, front elevational view of a button member of the key chain of FIG. 1.
Figure 5:
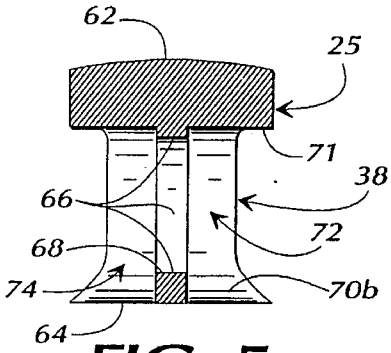
FIG. 5 is an isolated cross-sectional view of the button member of FIG. 4, taken along line 5—5 of FIG. 4

FIG. 4 is an isolated, front elevational view of the button member 25, in accordance with the preferred embodiment of the present invention. FIG. 4 is also representative of an isolated, rear elevational view of the button member 25. FIG. 5 is an isolated cross-sectional view of the button member 25 taken along line 5—5 of FIG. 4, in accordance with the preferred embodiment of the present invention. FIG. 5 is also representative of a cross-sectional view taken in the direction opposite from that indicated by line 5—5. Referring to both FIGS. 4 and 5, the button member 25 defines a button top 62 that protrudes from the top opening 32 (FIGS. 2 and 3) and a button bottom 64 that is disposed within the secondary bore 56 (FIG. 3). The button aperture 38 extends through and is accessible at the front and rear of the button member 25. The button member 25 defines a collar 66 that encircles and protrudes into the button aperture 38. A lower portion of the collar 66 is referred to as a lip 68. As discussed in greater detail below, the lip 68 protrudes into the groove 48 (FIG. 2) to releasably connect the insert member 20 (FIG. 2) to the body 12 (FIGS. 1 and 3). The button member 25 further defines lower ledges 70*a,b* that protrude forward from the lip 68. Additionally, the button member 25 defines an upper ledge 71 protruding forward from the upper portion of the collar 66. As discussed in greater detail below, the ledges 70,71 contact the sleeve 22 (FIG. 1) to limit travel of the button member 25. Referring to FIG. 5, the collar 66 bisects the button aperture 38 to define a forward aperture 72 and a rear aperture 74.

Figure 6:
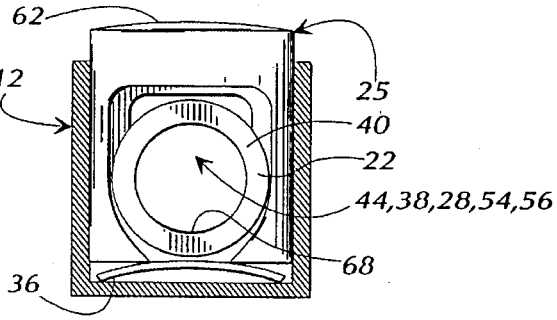
FIG. 6 is a partially cross-sectional, cut-away view of the key chain of FIG. 1, taken along line 5—5 of FIG. 1.

FIG. 6 is a partially cross-sectional, cut-away view taken along line 5—5 of FIG. 1, in accordance with the preferred embodiment of the present invention. The swivel member 26 (FIGS. 1 and 2), insert member 20 (FIGS. 1 and 2), and split rings 24 are cut-away, and the button 25, sleeve 22, and spring 36 are not cross-sectioned in FIG. 6. As depicted in FIG. 6, a large portion of the button member 25 is disposed within the secondary bore 56 (FIG. 3) and the button top 62 protrudes from the secondary bore 56 (FIG. 3). The spring 36 is sandwiched within the secondary bore 56 (FIG. 3) between the terminus 60 (FIG. 3) and the button bottom 64 (FIGS. 4 and 5). The portion of the primary bore 54 (FIG. 3) that is forward of the secondary bore 56 (FIG. 3) is preferably sized such that the sleeve 22 is securely and immovably press-fit thereinto. The sleeve front 40 preferably shares a common plane with the front end 14 (FIGS. 1 and 3) of the body 12. The sleeve rear 42 (FIG. 2) extends into the forward aperture 72 (FIG. 5) portion of the button aperture 38 and is proximate to, but forward of, the collar 66 (FIGS. 4 and 5). As discussed in greater detail below, FIG. 6 depicts the button member 25 in an intermediate position, whereby the lip 68 portion of the collar 66 (FIGS. 4 and 5) is just barely seen protruding above the lowest portion of the internal surface 43 (FIG. 2) of the sleeve 22.

Referring back to FIG. 1, they key chain 10 operates in a manner that facilitates ready connection and disconnection between the split rings 24. As discussed previously, the key chain 10 is depicted in the inserted configuration in FIG. 1. The inserted configuration is characterized by the fact that the insert member 20 is inserted into the body 12. As was also discussed previously, the key chain 10 is capable of being configured in the withdrawn configuration by depressing the button member 25 and withdrawing the insert member 20 from the body 12 such that the split rings 24 are disconnected. Referring back to FIG. 6, the button member 25 is capable of translational displacement, with respect to the body 12 and sleeve 22, between a first (or non-depressed ) position and a second (or depressed) position. When the button member is in the first position, the button member 25 is higher with respect to the sleeve 22 than is depicted in FIG. 6. In the first position, the lip 68 protrudes slightly further above the lowest point on the internal surface 43 (FIG. 2) of the sleeve 22 than is depicted in FIG. 6. When the button member 25 is in the second position, the button member 25 is lower with respect to the sleeve 22 than is depicted in FIG. 6. In the second position, the lip 68 does not protrude above the lowest point on the internal surface 43 (FIG. 2) of the sleeve 22. The spring 36 biases the button member 25 toward the first position. In accordance with the preferred embodiment of the present invention, the translational travel of the button member 25 is restricted. The button member 25 is incapable of traveling beyond the first position because when the first position is reached the lower ledges 70*a, b* (FIG. 4 and 5) contact the lower exterior portions of the sleeve 22 (FIG. 1) proximate to the sleeve rear 42 (FIG. 1). The button member is incapable of traveling beyond the second position because when the second position is reached the upper ledge 71 (FIGS. 4 and 5) contacts the upper exterior portion of the sleeve 22 (FIG. 1) proximate to the sleeve rear 42 (FIG. 1). In accordance with alternate embodiments of the present invention, translational travel is restricted by virtue of the fact that it is difficult to fully compress the spring 36 or because the terminus 60 (FIG. 3) is encountered. In accordance with the preferred embodiment of the present invention, rotation of the button member 25 is also restricted. As the button member 25 seeks to rotate, the vertical portions of the collar 66 contact the sleeve rear 42 (FIG. 2), whereby excessive rotation is precluded.

Referring back to FIG. 2, the key chain 10 operates, in accordance with the preferred embodiment of the present invention, such that the inserted configuration is capable of being easily achieved without directly operating the push button 25. The insertion end 46 of the insert member 20 is preferably inserted through the sleeve bore 44 while the button member 25 is in the first position. As the insertion end 46 exits the sleeve rear 42, the insertion end 46 contacts the lip 68 (see also FIGS. 4–6) of the button member 25. As the insertion end 46 is forced further toward the rear end 16, the generally rounded and smooth nature of the insertion end 46 functions to allow the insertion end 46 to slide across and force the lip 68 downward such that the button member 25 is forced toward the second position. As the insertion 46 end is forced further toward the rear end 16, the insert member 20 slides across the lip 68. However, when the groove 48 reaches the lip 68, the spring 36 forces the lip 68 upward such that button member 25 achieves the first position, whereby the lip 68 partially occupies the groove 48 and the insert member 20 is releasably latched to the body 12. In accordance with the preferred embodiment of the present invention, the spring 36 functions to force the lip 68 into the groove 48 with sufficient force to cause a readily audible click which provides assurance of a secure latch between the insert member 20 and the body 12. In accordance with the preferred embodiment of the present invention, one acceptable example of a spring 36 is a seven pound "wave" spring having a 0.014 inch displacement, and only 0.012 inches of that displacement are utilized.

In accordance with the preferred embodiment of the present invention, once the key chain 10 is in the inserted configuration, the key chain 10 operates such that the withdrawn configuration is capable of being easily achieved. By depressing the button top 62 (see also FIGS. 4–6) the second position is achieved, whereby the lip 68 (FIGS. 4–6) is withdrawn from the groove 48 and the insert member 20 is capable of being readily withdrawn from the body 12.

While certain of the preferred and alternate embodiments of the present invention have been disclosed herein, other embodiments of the apparatus and methods of the present invention will suggest themselves to persons skilled in the art in view of this disclosure. Therefore, it will be understood that variations and modifications can be effected within the spirit and scope of the invention and that the scope of the present invention should only be limited by the claims below. Furthermore, the equivalents of all means-or-step-plus function elements in the following claims are intended to include any structure, material, or acts for performing the function as specifically claimed which would be known by persons reasonably skilled in the art of this disclosure. Additionally, while it is intended that the scope of the present invention also include various alternate embodiments, it should be understood that each of the embodiments disclosed herein, including the preferred embodiment, includes features and characteristics which are considered independently inventive. Accordingly, the disclosure of variations and alterations expressed in alternate embodiments is intended only to reflect on the breadth of the scope of the present invention without suggesting that any of the specific features and characteristics of the preferred embodiment are in any way obvious or unimportant.

I claim:

1. A key chain assembly comprising:

a body member, including, at least, a body first end, a body second end, and a body side, wherein said body member defines, a first bore extending into said body member and accessible from said body first end, and a second bore extending into said body member, wherein said second bore is accessible from said body side and extends into said first bore, and wherein said second bore defines a bore terminus within said body member;

a button member movably disposed within said second bore and including, at least, a button top end accessible at said body side and a button bottom end disposed within said second bore, wherein said button member defines a button aperture interposed between said button bottom and said button top, wherein said button member is movable between a first position and a second position within said second bore, and wherein said button member is closer to said terminus when said button member is in said second position than when said button member is in said first position;

a spring member disposed within said second bore and interposed between said bore terminus and said button member, wherein said spring member biases said button member toward said first position;

a sleeve member disposed within said first bore and defining a sleeve bore therethrough, wherein said sleeve member is connected to said body member and extends from within said first bore of said body member into said button aperture, wherein said button member moves relative to said sleeve member and said first bore, and wherein said sleeve member contacts said button member to restrict movement of said button member and retain said button member within said second bore;

an insert member including, at least, a first insert end and a second insert end, wherein said first insert end is removably insertable through said sleeve bore and into said button aperture to define an inserted configuration, wherein when said insert member is in said inserted configuration and said button member is in said first position, said button member engages said insert member to resist withdrawal of said insert member from said first bore, and wherein when said insert member is in said inserted configuration and said button member is in said second position, said button member cooperates with said insert member to allow ready withdrawal of said insert member from said first bore;

a first retention means connected to said insert member for retaining keys; and a second retention means connected to said body member for retaining keys.

2. The key chain assembly of claim 1, wherein said button member further includes, at least, a lip protruding upward from said button bottom into said button aperture, and wherein said insert member defines a groove that is at least partially occupied by said lip when said insert member is in said inserted configuration and said button member is in said first position.

3. The key chain assembly of claim 2, wherein said sleeve member includes, at least, a sleeve top, a sleeve bottom, a sleeve first end oriented toward said body first end and a sleeve second end protruding into said button aperture, wherein said button member further includes, at least, a ledge extending below said lip and extending generally toward said sleeve member, and wherein said ledge contacts said sleeve bottom proximate to said sleeve second end when said button member is in said first position, whereby movement of said button member is restricted and said button member is retained within said second bore.

4. The key chain assembly of claim 1, wherein said button member defines an elongated central axis extending in a direction defined between said button top end and said button bottom end, and wherein said sleeve member further contacts said button member in a manner that restricts rotational movement of said button member about said central axis.

5. A key chain assembly for retaining a key, the key chain assembly comprising:

a body member, including, at least, a body first end, a body second end, and a body side, wherein said body member defines a cavity therein;

a button member movably disposed within said cavity and defining a button aperture;

a sleeve member disposed within said cavity and defining a sleeve bore therethrough, wherein said button member moves relative to said sleeve member, wherein said sleeve member is connected to said body member and extends into said button aperture, wherein said sleeve member contacts said button member to restrict movement of said button member, and wherein said sleeve bore is accessible at said body first end; and an insert member removably housed within said sleeve bore, wherein said button member engages said insert member to releasably attach said insert member to said body member; and a retention means connected to said insert member for retaining the key.

6. The key chain of claim 5, wherein said body member further defines an opening at said body side, and wherein said button member is accessible at said opening.

7. The key chain assembly of claim 6, wherein said retention means includes, at least, a split ring.

8. The key chain assembly of claim 6, wherein said button member is movable between first position and a second position within said cavity, wherein when said button member is in said first position said button aperture is closer to said body side that when said button member is in said second position, wherein said insert member includes, at least, a first insert end and a second insert end, wherein said first insert end is removably insertable through said sleeve bore and into said button aperture to define an inserted configuration, wherein when said insert member is in said inserted configuration and said button member is in said first position, said button member engages said insert member to resist withdrawal of said insert member from said bore, and wherein when said insert member is in said inserted configuration and said button member is in said second position, said button member cooperates with said insert member to allow ready withdrawal of said insert member from said bore.

9. The key chain assembly of claim 8, wherein said button member includes, at least, a button top end accessible at said opening and a button bottom end disposed within said cavity, wherein the key chain further comprises a spring member cooperating with said button member to bias said button member toward said first position, and wherein when said button member is in said first position said button bottom is closer to said body side than when said button member is in said second position.

10. The key chain assembly of claim 9, wherein said button aperture extends into said button member intermediate of said button top end and said button bottom end, wherein said button member further includes, at least, a lip protruding upward from said button bottom into said button aperture, and wherein said insert member defines a groove that is at least partially occupied by said lip when said insert member is in said inserted configuration and said button member is in said first position.

11. The key chain assembly of claim 10, wherein said sleeve member includes, at least, a sleeve top, a sleeve bottom, a sleeve first end oriented toward said body first end, and a sleeve second end protruding into said button aperture, wherein said button member further includes, at least, a ledge extending below and forward of said lip, and wherein said ledge contacts said sleeve bottom proximate to said sleeve second end when said button member is in said first position, whereby movement of said button member is restricted and said button member is retained, at least partially, within said cavity.

12. The key chain assembly of claim 5, wherein said button member includes a button top end and a button bottom end, wherein said button member defines an elongated central axis extending in a direction defined between said button top end and said button bottom end, and wherein said sleeve member further contacts said button member in a manner that restricts rotational movement of said button member about said central axis.

13. A latching assembly comprising:

a first body member, including, at least, a body first end, a body second end, and a body side, wherein said body member defines a cavity extending into said body member and accessible from said body first end;

an insert member removably insertable into said cavity, wherein an inserted configuration is defined when said insert member is inserted into said cavity;

a second body movably disposed within said cavity, wherein said second body defines an aperture, wherein said second body is movable between a first position and an second position within said cavity, wherein when said insert member is in said inserted configuration and said second body is in said first position, said second body engages said insert member to resist withdrawal of said insert member from said cavity, and wherein when said insert member is in said inserted configuration and said second body is in said second position, said second body cooperates with said insert member to allow ready withdrawal of said insert member from said cavity; and restriction means cooperating with said aperture and said second body for restricting movement of said second body between said first position and said second position.

14. The latching assembly of claim 13, further comprising a key retention means connected to said insert member.

15. The latching assembly of claim 13, wherein said restriction means includes, at least, an object connected to said first body and protruding into said aperture.

16. The latching assembly of claim 15, wherein said object comprises a sleeve member defining a sleeve bore therethrough, wherein said sleeve member extends from said cavity into said aperture and contacts said second body, and wherein said insert member extends into said sleeve bore when said insert member is in said inserted configuration.

17. The latching assembly of claim 16, further comprising a bias means for biasing said second body toward said first position.

18. The latching assembly of claim 17, further comprising a first key retention means connected to said insert member and a second key retention means connected to said first body.

19. The latching assembly of claim 13, wherein said movement of said second body between said first position and said second position is translational, and wherein said restriction means further cooperates with said aperture and said second body in a manner that restricts rotational movement of said second body.

20. The latching assembly of claim 15, wherein said second body moves relative to said object.

21. The latching assembly of claim 16, wherein said second body moves relative to said object.

22. A key chain assembly comprising:

a first body member, including, at least, a body first end, a body second end, and a body side, wherein said body member defines a cavity therein that is accessible at said body first end;

an insert member for insertion into and removal from said cavity;

a collar member disposed within said cavity and connected to said first body member for movement between a first position and a second position, wherein when said insert member is inserted into said cavity and said collar member is in said first position, said collar member at least partially encircles and engages said insert member to resist withdrawal of said insert member from said cavity, and wherein when said insert member is inserted into said cavity and said collar member is in said second position, said collar member cooperates with said insert member to allow ready withdrawal of said insert member from said cavity;

an object connected to said first body member, wherein said collar member moves relative to, at least partially encircles, and contacts said object, and wherein said contact between said object and said collar member restricts movement of said collar member and retains attachment of said collar member to said first body member when said insert member is removed from said cavity; and a key retention means connected to said insert member.

23. The key chain assembly of claim 22, wherein said restricting means restricts both translational and rotational movement of said collar member.

24. The key chain of claim 22, wherein said object includes, at least a sleeve defining a sleeve bore, wherein said insert member inserts through said sleeve bore.

* * * * *